United States Patent [19]

Hoshi

[11] 4,388,900

[45] Jun. 21, 1983

[54] AUTOMATIC STOPPING DEVICE FOR DIESEL ENGINE

[75] Inventor: Yoshikazu Hoshi, Tokai, Japan

[73] Assignee: Hitachi, Ltd., Tokyo, Japan

[21] Appl. No.: 293,217

[22] PCT Filed: Dec. 5, 1980

[86] PCT No.: PCT/JP80/00298

§ 371 Date: Aug. 5, 1981

§ 102(e) Date: Aug. 5, 1981

[87] PCT Pub. No.: WO81/01725

PCT Pub. Date: Jun. 25, 1981

[30] Foreign Application Priority Data

Dec. 7, 1979 [JP] Japan ..... 54/158068

[51] Int. Cl.[3] ..... F02B 77/00

[52] U.S. Cl. ..... 123/198 DB; 123/631; 123/198 D

[58] Field of Search ..... 123/198 D, 198 DB, 631, 123/643

[56] References Cited

U.S. PATENT DOCUMENTS

| | | | |
|---|---|---|---|
| 3,763,397 | 10/1973 | Yockens | 123/198 D |
| 3,993,038 | 11/1976 | Alt et al. | 123/198 DB |
| 4,054,117 | 10/1977 | Palmen et al. | 123/198 D |
| 4,080,940 | 3/1978 | Fuzzell et al. | 123/631 |
| 4,086,894 | 5/1978 | Capurka et al. | 123/643 |

*Primary Examiner*—Ira S. Lazarus

*Attorney, Agent, or Firm*—Antonelli, Terry & Wands

[57] ABSTRACT

This invention relates to an automatic stopping device for stopping a diesel engine through cutting off the fuel supply to the latter upon detect of an accidental reversing of the diesel engine. The reversing of automobile diesel engines is rather easy to occur. In the event of an accidental reversing of the diesel engine, it is necessary to stop the engine immediately, for otherwise the engine may be damaged seriously. According to the invention, the reversing of the diesel engine is detected through the detection of change of phase relation between two phases of output voltage derived from a multi-phase alternator connected to the engine and for charging up the batteries, the change of phase relation occuring when the engine is accidentally reversed. More specifically, the device includes a delay-type flip flop having a data input terminal for receiving the output voltage of one of the phases of the alternator and a clock input terminal adapted to receive the output voltage of another phase, such that an output voltage of a high voltage and low voltage are generated at the output terminal of the flip-flop when the engine is running in the forward and backward direction. The device further includes an engine stopping actuator adapted to stop the diesel engine upon receipt of the low level signal.

4 Claims, 2 Drawing Figures

AUTOMATIC STOPPING DEVICE FOR DIESEL ENGINE

TECHNICAL FIELD

The present invention relates to a device for automatically stopping a diesel engine and, more particularly, to an automatic stopping device for automatically stopping a diesel engine upon detect of reversing of the latter.

BACKGROUND ART

In diesel engines for automobiles, it is essential that the engine be stopped without delay in the event that the engine is accidentally reversed. When the diesel engine is reversed, an oil pump directly connected to the engine is also reversed so that the delivery pressure of the pump is lowered. It is possible to detect the reversing of the diesel engine through the detection of lowering of the delivery pressure of the pump, and by operating an actuator for stopping the engine in response to the detection of the lowering of the oil pressure by means of a pressure switch, the engine can be stopped without delay after the reversing. An example of such stopping device is shown in Japanese Patent Laid-open No. 1522/1973.

Another known automatic stopping device incorporates a vacuum pump connected to the diesel engine, adapted to produce a vacuum output by which braking mechanism is actuated. When the engine operates in the correct direction, a vacuum greater than a predetermined level is produced at the suction side of the vacuum pump. However, as the diesel engine is reversed, a positive pressure is produced at the suction side of the vacuum pump. It is, therefore, possible to automatically stop the diesel engine when the latter happens to be reversed, by using, in combination, a pressure responsive means associated with the suction side of the vacuum pump and an actuator for stopping the diesel engine when a predetermined positive pressure is reached at the suction side of the vacuum pump. This type of automatic stopping device is shown in Japanese Utility Model Publication No. 53-24600.

These conventional automatic stopping device can stop the diesel engine automatically and without fail when the diesel engine is accidentally reversed, but involve a problem of impractically large time lag of operation. More specifically, the first-mentioned type device requires 2 to 4 seconds before the oil pressure switch operates after the commencement of the reversing, and the second-mentioned type of the stopping device requires also 2 to 4 seconds until the predetermined level of the positive pressure is reached at the suction side of the vacuum pump after commencement of reversing of the latter.

DISCLOSURE OF INVENTION

Accordingly, an object of the invention is to provide a device capable of automatically stopping the diesel engine without delay after commencement of the reversing of the diesel engine.

Another object of the invention is to provide a fail-safe and reliable automatic stopping device for diesel engines.

To these ends, according to the invention, the reversing of the diesel engine is detected by detecting, while using the voltage of one phase of a multi-phase alternator connected to the engine as a reference, the phase relation between the reference voltage and other phase voltages.

BEST MODE FOR CARRYING OUT THE INVENTION

Figure 1:
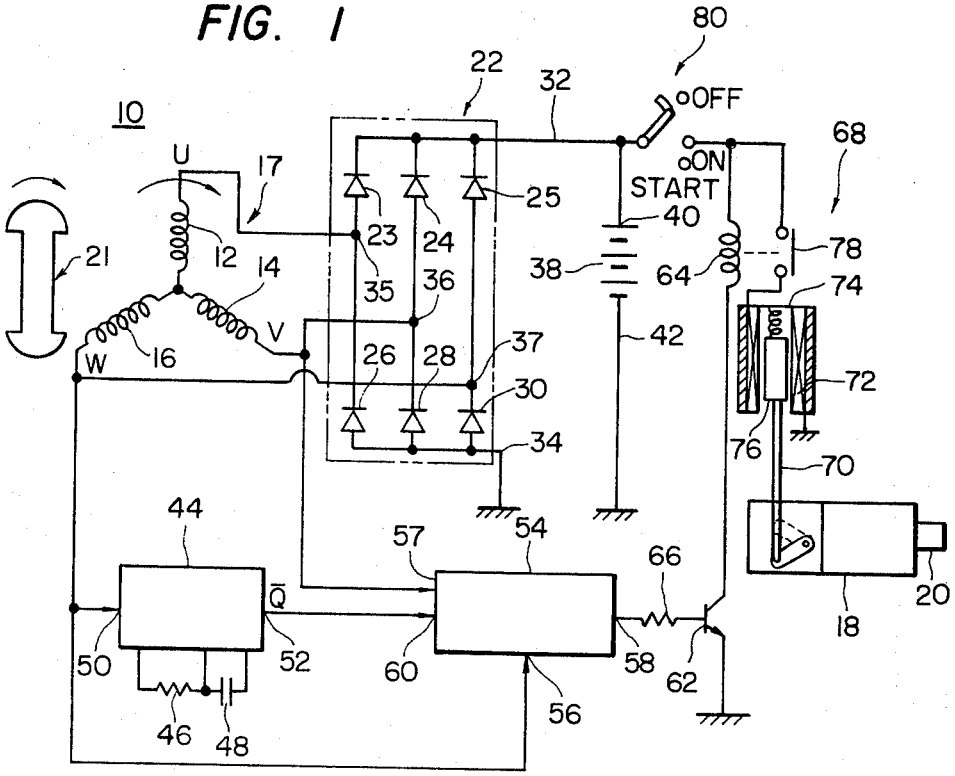
FIG. 1 is a circuit diagram of an embodiment of the invention.

Referring to FIG. 1, a 3-phase alternator 10 has a stator 17 provided with coils 12,14,16 of three phases and a rotor 21 connected to the output shaft 20 of a diesel engine 18. As the rotor 21 rotates, three-phase A.C. current is produced in the phase rotation as indicated by arrow. The following explanation will be made on an assumption that the rotational direction shown by this arrow is the forward direction. A rectifier 22 has 6 (six) diodes 23,24,25, 26,28,30 connected in the form of a 3-phase bridge. The cathodes of the diodes 23,24,25 are commonly connected to a positive output terminal 32, while the anodes of the diodes 26,28,30 are connected commonly to a negative output terminal 34 and are grounded. The anodes of the diodes 23,24,25 are connected to the cathodes of the diodes 26,28,30 at junctions 35,36,37 which in turn are connected to the output coils 12,14,16 which produce the phase voltages of U,V and W phases, respectively.

The positive terminal 40 of a battery is connected to the positive output terminal 32, while the negative terminal 42 is grounded. During the operation of the diesel engine 18, the battery 38 is floatedly charged by the output from the rectifier 22. A monostable multivibrator 44 is provided with a resistor 46 and a capacitor 48, and keeps the positive state over a predetermined period from an instant at which the input voltage at an input terminal 50 is changed from the low level to the high level and is then stabilized. Therefore, the output signal from the output terminal 52 is maintained at the low level for a predetermined period $T_D$ from the instant at which the input level at the input terminal 50 is changed from the low level to the high level. For instance, assuming here that the active state is preserved by a trigger pulse, the active state is further preserved from the instant at which the next trigger pulse is shifted from the low level to the high level, over a predetermined period $T_D$ which is determined by the resistance 46 and the capacitor 48. This type of monostable multivibrator is usually referred to as "retriggerable monostable multivibrator". A multivibrator sold under the name of CD 4047 sold from RCA company can be used as this retriggerable monostable multivibrator.

A delay type flip-flop 54 is adapted to memorize the states of input signal to the input terminal 57 at moments $t_1,t_2,t_3$ at which the input at the clock input terminal 56 is shifted from low level to high level, and to deliver the content of the memory to the output terminal 58. This type of flip-flop is generally called "delay-type flip-flop", a typical example of which is CD 4013 sold from R.C.A. company. The input terminal 50 of the multivibrator 44 and the clock input terminal 56 of the flip-flop 54 are connected to the output coil 16. The output terminal 52 of the multivibrator 44 is connected to a reset terminal 60 of the flip-flop 54.

A transistor 62 is provided with an emitter, collector and a base. The collector is connected to a controlling coil 64 for an actuator of the diesel engine, while the emitter is grounded. The base is connected through a resistance 66 to the output terminal 58 of the flip-flop 54. The actuator 68 for controlling the operation of the diesel engine 18 has a lever 70, solenoid 72, reset spring 74 and an armature 76, and is connected to the positive terminal 32 through a contact which is closed during energization of the controlling coil 64 and a key switch 80.

As the diesel engine 18 operates in the forward direction, voltages in the form of sine waves are induced in the phase coils 12,14,16 of the 3-phase alternator. Since the battery 38 is charged up through the diodes 23-30 constituting the rectifier 22, a half-wave rectified output having a rectangular wave form is generated in the output terminal of each coil as will be seen from FIGS. 2A and 2B.

Figure 2:
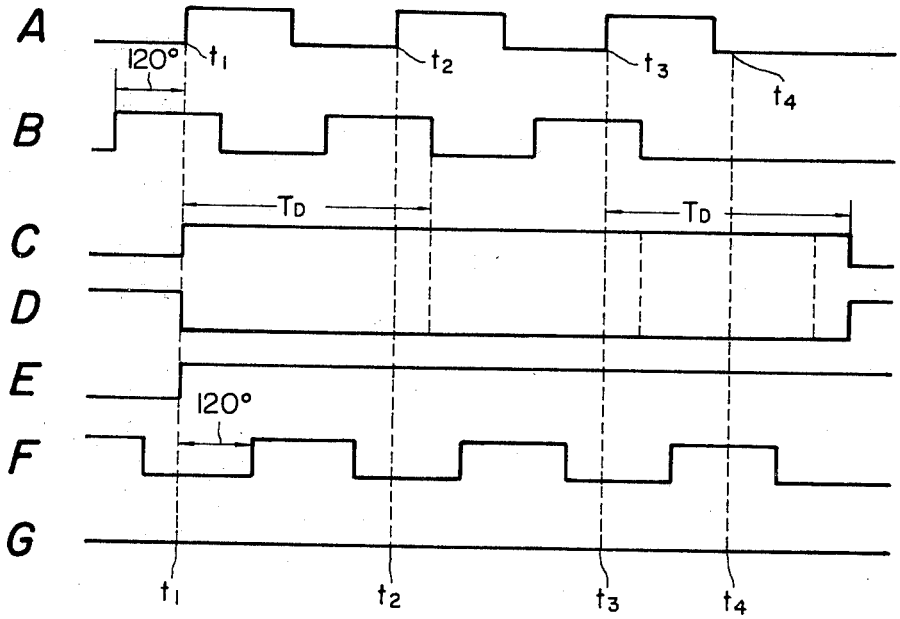
FIG. 2 is a waveform chart of signals obtained at every points of the circuit shown in FIG. 1.

When the 3-phase alternator 10 operates in the forward direction, the phase voltage of W phase appearing at the output coil 16 has a waveform as shown in FIG. 2A, while the voltage of V phase appearing in the output coil 14 has a waveform as shown in FIG. 2B because this phase is in 120° advance to the W phase. The input at the data input terminal 57 at the moments $t_1,t_2,t_3$ at which the input at the clock terminal 56 of the flip-flop 54 is changed from the low level to the high level, so that an output voltage of a high level is obtained at the output terminal 58 of the flip-flop 54 as will be seen from FIG. 2E.

The transistor 62 maintains the conductive state when the high voltage is available at the output terminal 58 of the flip-flop 54, so that the controlling coil 64 is energized. In consequence, the solenoid 72 is energized to rotate the lever 70 downwardly and hold the same at the lowered position overcoming the force of the spring 74, thereby to permit the diesel engine to continue to operate.

However, when the diesel engine is accidentally started in the reverse or backward direction, the phase of voltage in the V phase appearing in the output coil 14 lags 120° behind the voltage of W phase as shown in FIG. 2F. Therefore, the input at the data input terminal 57 takes the low level at the moments $t_1,t_2,t_3$ at which the input voltage to the clock input terminal 56 of the flip-flop 54 is changed from the low level to the high level, so that a signal of low level is generated at the output terminal of the flip-flop 54 as shown in FIG. 2G. As the output from the flip-flop comes to take the low level, the transistor 62 is turned off so that the controlling coil 64 is de-energized to open the contact 78. In consequence, the solenoid 78 is de-energized and the lever 70 is returned by the spring 74 thereby to cut-off the fuel supply to the diesel engine 18 to stop the latter.

Supposing here that the diesel engine 18 is happened to be stopped for any reason, the output voltage of the flip-flop 54 is maintained at the high level in spite that the diesel engine is not operating, to provide the sign of operation of the engine erroneously. The multivibrator 44 is provided to prevent this erroneous operation. The multivibrator 44 is intended for avoiding this erroneous operation. Namely, the multivibrator 44 takes the active state for a predetermined period $T_D$ as shown in FIG. 2C when the voltage of the output coil 16 is changed from the low level to the high level, and turns the output at the inversion output terminal 52 to the low level, as shown in FIG. 2D. This period $T_D$ is selected to be greater than the period of output voltage from the output coil 16 at a predetermined low enging speed No. Therefore, when the diesel engine 18 is running at a speed higher than the predetermined speed,, the monostable multivibrator 44 is triggered at least once within the period $T_D$, so that the output terminal thereof is maintained always at the low level. Therefore, the delay-type flip-flop 54 does not receive the reset input at its reset terminal 60.

However, when the output voltage of the output coil 16 is maintained at the low level due to a stop of the alternator 10 at a moment $t_4$, the monostable multivibrator 44 provides an output at its output terminal 52 at a time $T_D$ after the instant $t_3$ as shown in FIG. 2D, so that the flip-flop 54 receives a reset signal at its reset terminal 60. In consequence, the output from the flip-flop 54 takes the low level.

According to the invention, the rotation detector operates continuously to supply the forward rotation signal to the actuator. It is, therefore, possible to stop the diesel engine automatically without fail even when the output from the flip-flop 54 is extinguished due to a trouble.

What is claimed is:

1. An automatic stopping device for diesel engines comprising: a multi-phase alternator connected to the output shaft of a diesel engine and having a plurality of output coils; a delay-type flip-flop having a data input terminal connected to the output coil of one of the phases of said multi-phase alternator and adapted to receive an input signal having forms of low and high levels, and a clock input terminal connected to the output coil of another phase of said multi-phase alternator and adapted to receive an input signal having the forms of low and high levels, said flip-flop being adapted to memorize the form of the input signal at said data input terminal when the form of input signal at said clock input terminal is changed from one to the other; and an engine stopping actuator having an input terminal connected to the output terminal of said delay-type flip-flop; the phase relation of said input signals to said data input terminal and said clock input terminal being so selected that, when said engine is operating in the forward direction, a high level signal representing the forward operation is generated at said output terminal of said delay-type flip-flop while, when said engine operates in the backward direction, a low level signal representing the backward operation is generated at said output terminal of said delay-type flip-flop, said engine stopping actuator being adapted to stop said diesel engine in response to said low level signal.

2. An automatic stopping device for diesel engines comprising: a 3-phase alternator connected to the output shaft of a diesel engine and provided with output coils of three phases; a 3-phase bridge rectifier having an input terminal connected to the output coils of said 3-phase alternator and an output terminal connected to the positive and negative terminals of a battery; a delay-type flip-flop having a data input signal connected to the output coil of one of three phases of said 3-phase alternator and adapted to receive an input signal having forms of a low and high levels, a clock input terminal connected to said output coil of another phase of said 3-phase alternator and adapted to receive an input signal having forms of a low and high levels, a reset terminal and an output terminal, said delay-type flip-flop being adapted to memorize the form of said input signal at said data input terminal at the moment at which the form of said input signal at said clock input terminal is changed from one to the other; a time limit device having an input terminal connected to said output coil of said another phase of said 3-phase alternator and adapted to receive an input signal having forms of a low and high levels, and an output terminal connected to said reset terminal of said delay-type flip-flop, said time limiting device being adapted to produce, after elapse of a predetermined time from the moment at which the form of said signal at said input terminal is changed from one to the other, an output signal to reset said delay-type flip-flop; and an engine stopping actuator having an input terminal connected to said output terminal of said delay-type flip-flop, the phase relation between the input signals to said data input terminal and said clock input terminal being so selected that, when said diesel engine is operating in the forward direction, a high level signal representing the forward operation is generated at said output terminal of said delay-type flip-flop, while, when said engine is operating in the backward direction, a low level signal representing the backward operation is generated at said output terminal of said delay-type flip-flop, said engine stopping actuator being adapted to act to stop said diesel engine in accordance with said low level signal.

3. An automatic stopping device for diesel engines as claimed in claim 2, wherein said time-limiting device is a retriggerable multivibrator adapted to measure the time at each time of receipt of a trigger pulse and to produce said output at its output terminal after elapse of a predetermined time length from the receipt of said trigger pulse.

4. An automatic stopping device for diesel engines as claimed in claim 2, wherein said predetermined time is so selected that said time-limiting device produces said output at its output terminal when said diesel engine is operating at a speed below a predetermined speed.

* * * * *